US011091230B2

(12) United States Patent
Curts et al.

(10) Patent No.: US 11,091,230 B2
(45) **Date of Patent: *Aug. 17, 2021**

(54) AFT-FACING TRANSOM SEATING FOR A BOAT

(71) Applicant: MasterCraft Boat Company, LLC, Vonore, TN (US)

(72) Inventors: Chadrick E. Curts, Lenoir City, TN (US); Daniel P. Vieira, Madisonville, TN (US); Rosemary M. Bennett, Seymour, TN (US); David F. Ekern, Knoxville, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/570,574

(22) Filed: Sep. 13, 2019

(65) Prior Publication Data

US 2020/0010154 A1 Jan. 9, 2020

Related U.S. Application Data

(63) Continuation-in-part of application No. 16/442,652, filed on Jun. 17, 2019, now Pat. No. 10,604,217, which is a continuation of application No. 15/587,674, filed on May 5, 2017, now Pat. No. 10,336,411, which is a continuation of application (Continued)

(51) Int. Cl.

| | |
|---|---|
| ***B63B 29/04*** | (2006.01) |
| ***B63B 3/54*** | (2006.01) |
| ***B63B 32/70*** | (2020.01) |

(52) U.S. Cl.

CPC ..... *B63B 29/04* (2013.01); *B63B 3/54* (2013.01); *B63B 32/70* (2020.02); *B63B 2029/043* (2013.01)

(58) Field of Classification Search

CPC ..... B63B 29/04; B63B 2029/043; B63B 3/54; B63B 32/70

See application file for complete search history.

(56) References Cited

U.S. PATENT DOCUMENTS

| | | | |
|---|---|---|---|
| 794,777 | A | 7/1905 | Bunnell |
| 3,964,785 | A | 6/1976 | Plume |

(Continued)

OTHER PUBLICATIONS

MasterCraft, 2013 Owner's Manual, pp. cover, ix, 2-23 to 2-26, and 3-27 to 3-28.

(Continued)

*Primary Examiner* — Stephen P Avila
(74) *Attorney, Agent, or Firm* — Venable LLP

(57) ABSTRACT

A boat including one or more seats, which may be aft-facing. The seat includes a seat bottom, which may be movable between a first position and a second position. The second position is a position in which the seat bottom is pivoted upwardly relative to the position of the seat bottom in the first position to allow access to a hidden compartment. The seat may also include a leg rest. The leg rest may extend aft of the transom, and may extend in a direction that is at a downward angle relative to the seat bottom. The leg rest may also have a length such that a gap is present between the leg rest and a surface beneath the leg rest.

20 Claims, 10 Drawing Sheets

Related U.S. Application Data

No. 14/845,606, filed on Sep. 4, 2015, now Pat. No. 9,650,117, which is a continuation-in-part of application No. 29/501,577, filed on Sep. 5, 2014, now Pat. No. Des. 743,318.

(60) Provisional application No. 62/046,394, filed on Sep. 5, 2014.

(56) References Cited

U.S. PATENT DOCUMENTS

| | | | |
|---|---|---|---|
| 4,085,473 | A | 4/1978 | Franklin |
| 4,879,963 | A | 11/1989 | Dionne |
| D310,059 | S | 8/1990 | Porter |
| D322,422 | S | 12/1991 | Carlson |
| 5,136,963 | A | 8/1992 | Zuzik |
| D333,810 | S | 3/1993 | Wenstadt |
| 5,320,059 | A | 6/1994 | Ikeda |
| 5,346,277 | A | 9/1994 | Holobaugh et al. |
| D356,289 | S | 3/1995 | Trent |
| D357,223 | S | 4/1995 | Thompson et al. |
| 5,481,998 | A | 1/1996 | Trent |
| 5,497,724 | A | 3/1996 | Brown et al. |
| 6,041,732 | A | 3/2000 | Ikeda |
| D429,682 | S | 8/2000 | Garland et al. |
| 6,145,458 | A | 11/2000 | Hattori |
| 6,257,667 | B1 | 7/2001 | Boren et al. |
| 6,371,559 | B1 | 4/2002 | Kienzle et al. |
| 6,431,109 | B1 | 8/2002 | Martin |
| D464,601 | S | 10/2002 | Aube et al. |
| 6,491,124 | B1 | 12/2002 | Thompson et al. |
| D469,053 | S | 1/2003 | Aube et al. |
| 6,672,240 | B1 | 1/2004 | Aube et al. |
| 6,837,173 | B2 | 1/2005 | Eck et al. |
| 6,886,490 | B2 | 5/2005 | Aube et al. |
| 7,000,557 | B1 | 2/2006 | Forbes et al. |
| D524,224 | S | 7/2006 | Guay et al. |
| 7,255,058 | B2 | 8/2007 | Forbes et al. |
| 7,661,382 | B2 | 2/2010 | Wood et al. |
| 8,113,136 | B2 | 2/2012 | Mayrand et al. |
| D665,719 | S | 8/2012 | Watkins et al. |
| D679,236 | S | 4/2013 | Gros et al. |
| 8,517,466 | B1 | 8/2013 | Wizorek et al. |
| 8,616,143 | B2 | 12/2013 | Hancock, Jr. et al. |
| D700,127 | S | 2/2014 | Fuller, IV |
| 8,943,988 | B1 * | 2/2015 | Guglielmo ..... B63H 21/24 114/163 |
| 9,249,827 | B2 | 2/2016 | Serocki et al. |
| 9,650,117 | B2 | 5/2017 | Curts et al. |
| 10,336,411 | B2 | 7/2019 | Curts et al. |
| 10,604,217 | B2 * | 3/2020 | Curts ..... B63B 32/70 |
| 2008/0196649 | A1 | 8/2008 | Kalil |
| 2009/0301378 | A1 | 12/2009 | Walbridge et al. |
| 2010/0037814 | A1 | 2/2010 | Sahr et al. |
| 2010/0319604 | A1 * | 12/2010 | Mayrand ..... B63B 29/02 114/363 |
| 2011/0095592 | A1 | 4/2011 | Willard et al. |
| 2013/0160695 | A1 * | 6/2013 | Gratz ..... B63H 20/04 114/362 |
| 2014/0225403 | A1 | 8/2014 | Shimada et al. |

OTHER PUBLICATIONS

Charles Plueddeman, Surf Everywhere, Boating, Mar. 2015, pp. cover, 10, 68-73.

The AL-24 Wake Boat, http://pevati.com/al-24/, last visited Aug. 4, 2014.

Bombardier Recreational Products Inc., 210 Wake, Aug. 4, 2011.

Yamaha Motor Corporation, 2014 Yamaha Boats.

Sea Ray Boats, 300 Sundeck, Sep. 2012.

Chaparral Boats, 2013 Chaparral Fleet Brochure, available at http://www.chaparralboats.com/publications/uploaded_files/121/2013-ChapMini.pdf.

Randy Vance, Cobalt A25, Boating, Apr. 29, 2010, available at http://www.boatingmag.com/boats/cobalt-a25?image=3.

Metal Moulding Corp., Slide Out, Flip Up, Rotating Hinge, http://www.metalmoulding.com/Slide_out_flip_up_rotating_hinge.html (last visited Aug. 31, 2015).

* cited by examiner

AFT-FACING TRANSOM SEATING FOR A BOAT

CROSS REFERENCE TO RELATED APPLICATIONS

This application is a continuation-in-part of U.S. patent application Ser. No. 16/442,652, filed Jun. 17, 2019. U.S. patent application Ser. No. 16/442,652 is a continuation of U.S. patent application Ser. No. 15/587,674, filed May 5, 2017, now U.S. Pat. No. 10,336,411. U.S. patent application Ser. No. 15/587,674 is a continuation of U.S. patent application Ser. No. 14/845,606, filed Sep. 4, 2015, now U.S. Pat. No. 9,650,117. U.S. patent application Ser. No. 14/845,606 claims the benefit under 35 U.S.C. § 119(e) of U.S. Provisional Patent Application No. 62/046,394, filed Sep. 5, 2014, and titled "Aft-Facing Transom Seating for a Boat." U.S. patent application Ser. No. 14/845,606 is also a continuation-in-part of U.S. patent application Ser. No. 29/501,577, filed Sep. 5, 2014, now U.S. Pat. No. D743,318.

FIELD OF THE INVENTION

This invention relates to seating for a boat, particularly aft-facing seating positioned proximate to the transom of the boat.

BACKGROUND OF THE INVENTION

Boats are used to tow watersports performers, such as water skiers, wakeboarders, and the like, using a tow-line. The performer holds onto one end of the tow-line and the other end is attached to the boat. A boat may also be used to generate a wake on which a watersports performer, such as a wake-surfer, may wake-surf. People in the boat often desire to watch the watersports performer, and in some states, a spotter is required by law. Because the watersports performers are behind the boat, it is desirable to have an aft-facing seat, and in particular, one positioned near the transom, to be as close to the action as possible. Further, the aft-facing seat should be one that can be safely occupied while the boat is moving. Seating in these locations and in these configurations may also be used for lounging, and the seating may be designed with various features to enhance an occupant's comfort when seated in the seats.

SUMMARY OF THE INVENTION

In one aspect, the invention relates to a boat including a hull, an aft-facing seat, and a plurality of handles. The hull includes a bow, a transom, and port and starboard sides. The aft-facing seat is positioned proximate to the transom and includes a seat bottom that is inclined at a downward angle in a direction extending from aft to fore. One of the plurality of handles is positioned at an outboard side of the aft-facing seat and another one of the handles positioned an inboard side of the aft-facing seat.

In another aspect, the invention relates to a boat including a hull and an aft-facing seat. The hull includes a bow, a transom, and port and starboard sides. The aft-facing seat is positioned proximate to the transom and includes a seat bottom, a seatback, a headrest, and a seat support structure having at least one hidden compartment therein. The aft-facing seat also includes at least one pivot mechanism attached to the seatback and the headrest and configured to allow: (1) the seatback to move between a first position in which the seatback is capable of supporting the back of a person seated in the seat and a second position in which the seatback is pivoted upwardly to allow access to the compartment; and (2) the headrest to move between an upright position and a folded position.

In a further aspect, the invention relates to a boat including a hull, an aft-facing seat, and a plurality of handles. The hull includes a bow, a transom, and port and starboard sides. The aft-facing seat is positioned proximate to the transom and includes a seat bottom, a seatback, a headrest, and a seat support structure having at least one hidden compartment therein. The seat bottom is inclined at a downward angle in a direction extending from aft to fore. The aft-facing seat also includes at least one pivot mechanism attached to the seatback and the headrest and configured to allow: (1) the seatback to move between a first position in which the seatback is capable of supporting the back of a person seated in the seat and a second position in which the seatback is pivoted upwardly to allow access to the compartment; and (2) the headrest to move between an upright position and a folded position. One of the plurality of handles is positioned at an outboard side of the aft-facing seat and another one of the handles positioned an inboard side of the aft-facing seat.

In still another aspect, the invention relates to a boat including a hull, a plurality of aft-facing seats, and a plurality of handles associated with each aft-facing seat. The hull includes a bow, a transom, and port and starboard sides. A first aft-facing seat is positioned port of a centerline of the boat and proximate to the transom, and a second aft-facing seat is positioned starboard of the centerline of the boat and proximate to the transom. Each aft-facing seat includes a seat bottom, a seatback, a headrest, and a seat support structure having at least one hidden compartment therein. The seat bottom is inclined at a downward angle in a direction extending from aft to fore. Each aft-facing seat also includes at least one pivot mechanism attached to the seatback and the headrest and configured to allow: (1) the seatback to move between a first position in which the seatback is capable of supporting the back of a person seated in the seat and a second position in which the seatback is pivoted upwardly to allow access to the compartment; and (2) the headrest to move between an upright position and a folded position. One of the plurality of handles is positioned at an outboard side of each aft-facing seat and another one of the handles positioned an inboard side of each aft-facing seat.

In yet another aspect, the invention relates to a boat including a hull, a seat support structure, and an aft-facing seat. The hull includes a bow, a transom, port and starboard sides, and port and starboard gunwales. The seat support structure has at least one hidden compartment therein. The aft-facing seat is positioned proximate to the transom and supported by the seat support structure. The aft-facing seat includes a seat bottom and a seat back. The seat bottom is movable between a first position and a second position. When the seat bottom is in the first position, the seat bottom is inclined at a downward angle in a direction extending from aft to fore and a majority of the seat bottom is positioned forward of the transom. The second position is a position in which the seat bottom is pivoted upwardly relative to the position of the seat bottom in the first position to allow access to the compartment. The seatback joins the seat bottom at an intersecting location. When the seat bottom is in the first position, the intersecting location is forward of the transom and below the gunwales. The aft-facing seat may further include a leg rest extending aft of the seat bottom that is inclined at a downward angle in a direction extending from fore to aft.

In yet a further aspect, the invention relates to a boat including a hull and an aft-facing seat. The hull includes a bow, a transom, and port and starboard sides. The aft-facing seat is positioned proximate to the transom. The aft-facing seat includes a seat bottom and a leg rest. The leg rest extends aft of the transom.

In still a further aspect, the invention relates to a boat including a hull and a seat. The hull includes a bow and port and starboard sides. The seat includes a seat bottom and a leg rest. The leg rest extends in a direction that is at a downward angle relative to the seat bottom. The leg rest having a length such that a gap is present between the leg rest and a surface beneath the leg rest.

These and other aspects of the invention will become apparent from the following disclosure.

DETAILED DESCRIPTION OF THE PREFERRED EMBODIMENTS

As used herein, directional terms forward (fore), aft, inboard, and outboard have their commonly understood meaning in the art. Relative to the boat, forward is a direction towards the bow, and aft is a direction towards the stern. Likewise, inboard is a direction toward the center of the boat and outboard is a direction away from it.

Figure 1:
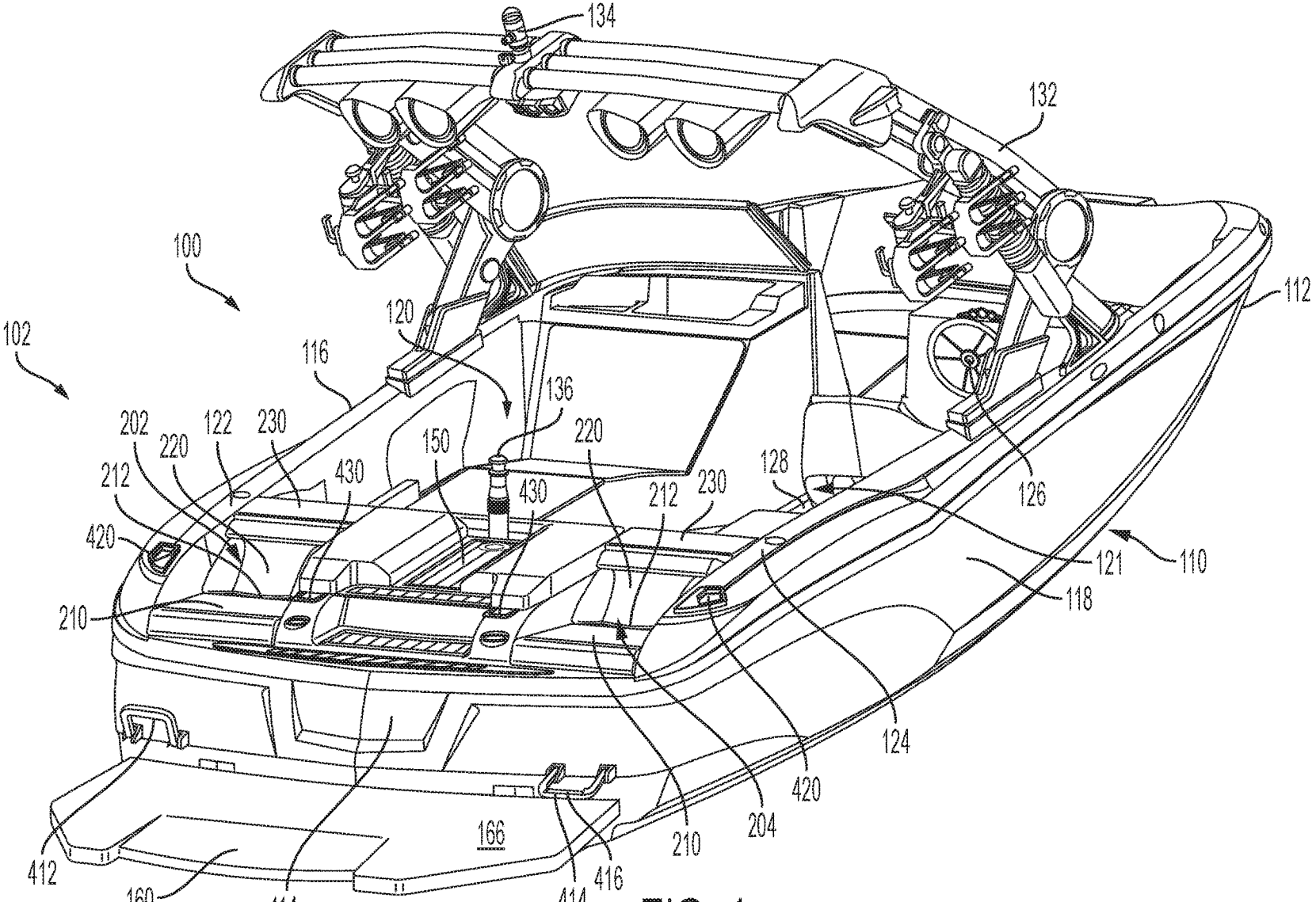
FIG. 1 shows a boat including a pair of aft-facing seats according to a preferred embodiment of the invention.

FIG. 1 shows a boat 100 equipped with a pair of aft-facing seats 202, 204 in accordance with a first preferred embodiment of the invention. The boat 100 includes a hull 110 with a bow 112, a transom 114, a port side 116, and a starboard side 118. The port and starboard sides 116, 118 have port and starboard gunwales 122, 124, respectively. Collectively, the bow 112, the transom 114, and the port and starboard sides 116, 118 define an interior 120 of the boat 100. Within the boat's interior 120 is a control console 126 for operating the boat 100 and a floor 128. Typically, the floor 128 is oriented in a plane that is parallel with the horizontal plane of the boat 100.

The boat 100 is also preferably equipped with at least one apparatus for towing a watersports performer. The apparatus may include, for example, a tower 132 equipped with a tow point 134 for towing a watersports performer such as a wakeboarder. The tow point 134 may include, for example, an integrated light and tow-line-attachment assembly such as described in U.S. Pat. No. 6,539,886. Other devices may be attached to the tower 132 including, for example, speakers and racks for holding wakeboards. The boat 100 may also be equipped with a ski pylon 136 for towing a watersports performer such as a water skier.

Figure 2:
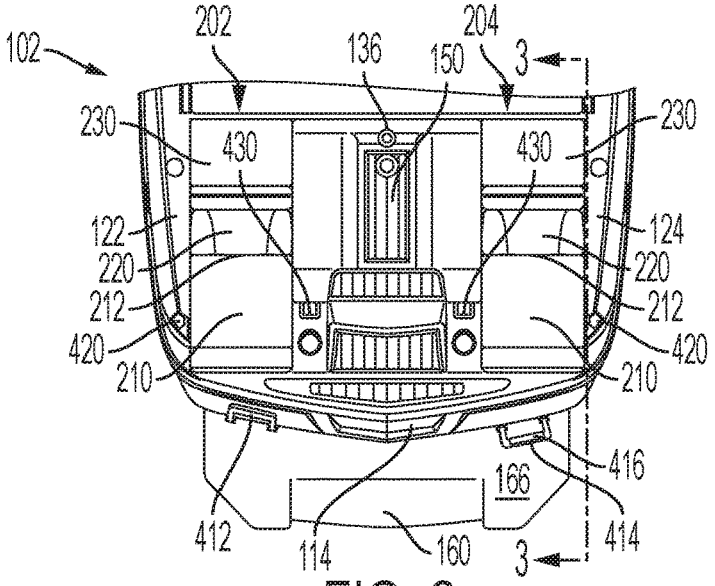
FIG. 2 is a top view of the stern of the boat shown in FIG. 1.
Figure 3:
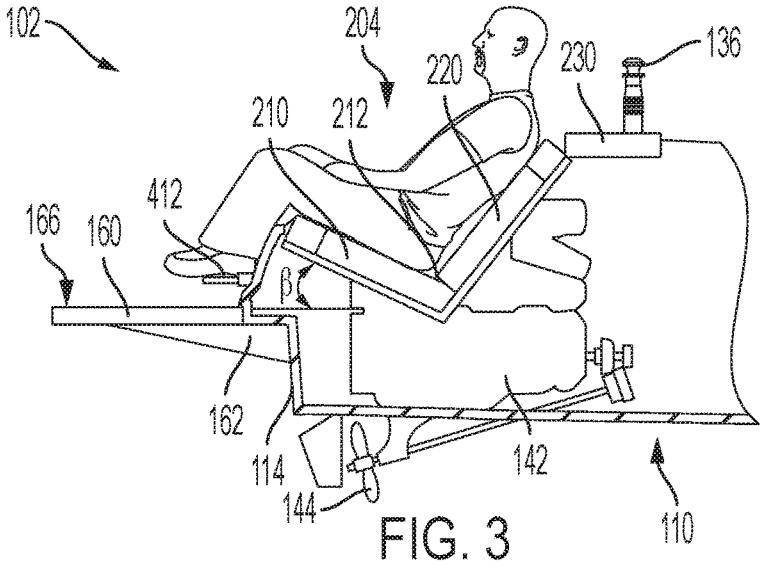
FIG. 3 is a cross-sectional view of the boat shown in FIG. 2 taken along line 3-3.
Figure 4:
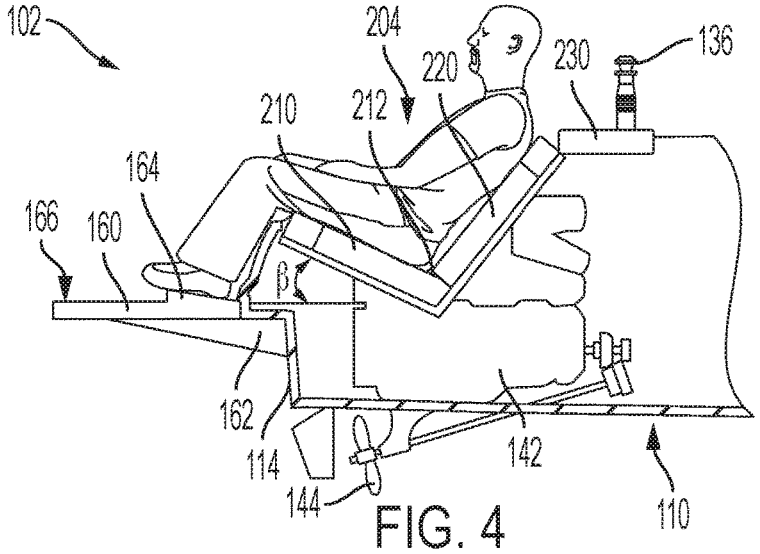
FIG. 4 is a cross-sectional view of the boat shown in FIG. 2 taken along line 3-3, having an alternative configuration of the swim platform.

FIGS. 3 and 4 show an inboard boat 100, which uses a motor 142 to drive a propeller 144 that is located under the hull 110 and forward of the transom 114. Inboard boats are often preferred for watersports because the propeller 144 is positioned underneath the boat 100 and away from watersports performers and swimmers. As shown in FIGS. 1 and 2, a motor box 150, located in the stern 102 of the boat 100, houses the motor 142. Preferably, the motor 142 and the motor box 150 are positioned proximate to the transom 114 to increase the displacement into the water of the stern 102 of the hull 110 for watersports such as wakeboarding and surfing. Any suitable motor 142 may be used, including the MV8 5.7L engine manufactured by Ilmor Marine of Mooresville, N.C. The motor 142 is preferably positioned along the center line of the boat 100, thus leaving room between the motor 142 and the port and starboard sides 116, 118 of the hull 110 for compartments 250 (see, e.g., FIGS. 7 and 8).

The boat 100 includes a horizontal swim platform 160 attached to the transom 114 to make it easier for people to get into the water from the boat 100 or out of the water into the boat 100. The swim platform 160 should be capable of supporting a human, and is preferably capable of supporting at least 500 lbs., and even more preferably 1250 lbs. When supporting a person, the person can stand or sit, for example, on an upper surface 166 of the swim platform 160. The swim platform 160 may be constructed from any suitable material that may be used in a marine environment including, for example, fiberglass and teak. In this embodiment, the swim platform 160 is attached to the transom 114 of the boat 100 using two brackets 162. In this embodiment, the fasteners used to attach the brackets 162 to the swim platform 160 and the transom 114 are screws; however, any suitable means of attachment known in the art may be used, including, but not limited to, bolts, rivets, welding, adhesive, and the like. Alternatively, the brackets 162 may be integrally formed into either the swim platform 160 or the transom 114 of the boat 100. Similarly, the swim platform 160 may be attached to the transom 114 by any suitable means and is not limited to the use of brackets 162. While the swim platform 160 is described as an attachable/detachable platform, it is not so limited. For example, the swim platform 160 may be integrally formed with the stern 102 of the boat 100.

The pair of aft-facing seats 202, 204 is located in the stern 102 of the boat 100. FIG. 2 is a top view of the stern 102 of the boat 100 showing the pair of aft-facing seats 202, 204, and FIG. 3 is a cross-sectional view of the stern 102 of the boat 100 taken along line 3-3 in FIG. 2. A port-side aft-facing seat 202 ("port seat") is located on the port side of the centerline of the boat 100, and a starboard-side aft-facing seat 204 ("starboard seat") is located on the starboard side of the centerline of the boat 100. As shown in this embodiment, the person faces directly aft when the seat is occupied; that is, the plane of a seatback 220 of the aft-facing seat 202, 204 is generally orthogonal to the centerline of the boat 100. However, the aft-facing seats 202, 204 do not need to be positioned to face the occupant directly aft. Instead, some deviations are contemplated to be within the scope of the invention, including, for example, angling the seatback 220 up to and including 45° relative to the centerline of the boat 100.

The aft-facing seats 202, 204 are designed to be occupied by a person while the boat 100 is either moving or at rest. Preferably, the aft-facing seats 202, 204 may be safely occupied while the boat 100 is moving at speeds appropriate for watersports such as water skiing (from 28 mph to 36 mph), wakeboarding (from 18 mph to 26 mph), and wake surfing (from 8 mph to 14 mph). As will be apparent from the discussion below, there are a number of features of the boat 100 that enable a person to safely occupy the aft-facing seats 202, 204 when the boat 100 is moving. Those skilled in the art will recognize that each of these features may be used in various combinations to achieve this non-limiting objective of the invention.

The pair of aft-facing seats 202, 204 are supported by a seat support structure 240 (see FIGS. 7 and 8) which, in this embodiment, is the motor box 150. Each aft-facing seat 202, 204 has seat bottom 210 and a seatback 220. The seat bottom 210 and the seatback 220 each have a structural member with a cushion covering the structural member. Preferably, the cushions are constructed from a soft, but supportive, material, such as triple-density foam, and are covered with a waterproof material, such as premium grade vinyl. Although they may be separate pieces, in this embodiment, the seat bottom structural member and the seatback structural member are an integral piece (collectively referred to as a seat structural member). The seat structural member may be made from any structural material suitable for the marine environment and capable of supporting the weight of an adult. Because the aft-facing seats 202, 204 are designed to be lifted (discussed further below), the structural members may be constructed from a light weight material, such as polyethylene, and made by rotomolding (also known as rotocasting). The seat structural member is generally L-shaped and the seat bottom structural member intersects with the seatback structural member at an intersecting point 212. The angle $\alpha$ (see FIG. 5) between a top surface of the seat bottom 210 and an aft-facing surface of the seatback 220 is set so that a person can comfortably sit in the seat 202, 204. Preferably, this angle $\alpha$ is 90° or greater, more preferably from 95° to 135°.

The aft-facing seats 202, 204 are positioned proximate to the transom 114 of the boat 100. In the embodiment shown in FIGS. 1-8, the aft-facing seats 202, 204 are positioned over the transom 114, and in particular, the seat bottom 210 is positioned above the transom 114. While seated in one of the aft-facing seats 202, 204, the majority of an adult's body is positioned forward of the transom 114, as shown in FIG. 3, and his or her legs extend aft, over the transom 114.

One feature of the aft-facing seats 202, 204, which allows one to safely occupy the aft-facing seats 202, 204 while the boat 100 is moving, is the positioning of the occupant's hips while seated. When seated, the occupant's hips are preferably positioned forward of the transom 114 and lower than the gunwales 122, 124. Thus the intersecting point 212 of the port seat 202 is forward of the transom 114 and lower than the port gunwale 122, and the intersecting point 212 of the starboard seat 204 is forward of the transom 114 and lower than the starboard gunwale 124. The amount by which the intersecting point 212 is lower than the gunwales 122, 124 (as measured to the top of the seat cushions) is preferably from 10 inches to 16 inches, which is similar to level of the seats in the boat's interior 120 relative to the gunwales 122, 124.

Another feature of the aft-facing seats 202, 204, which allows one to safely occupy the aft-facing seats 202, 204 while the boat 100 is moving, is the inclination of the seat bottom 210. The seat bottom 210 is inclined at a downward angle $\beta$ in a direction extending from aft to fore. This inclination helps keep the occupant pressed against the back of the aft-facing seat 202, 204 when the boat 100 is moving. Because the bow 112 of the boat 100 may rise as the boat 100 accelerates and moves through the water, the angle $\beta$ of the seat bottom 210 preferably compensates for the inclination of the boat 100 to maintain a downward angle while the boat 100 is in motion. Preferably, the downward angle $\beta$ of the seat bottom 210 is from 5° to 20° relative to the floor 128 of the boat 100, more preferably 18° relative to the floor 128.

As shown in FIG. 3, the boat 100 includes a pair of footrests 412, 414. Each footrest 412, 414 is associated with one of the aft-facing seats 202, 204. One footrest 412 is on the port side of the centerline of the boat 100 and positioned below the seat bottom 210 of the port seat 202. The other footrest 414 is on the starboard side of the centerline of the boat 100 and positioned below the seat bottom 210 of the starboard seat 204. When a person sits in the aft-facing seat 202, 204, his or her feet may rest on an upper surface 416 of the associated footrest 412, 414. The occupant may push against the upper surface 416 of the footrest 412, 414 with his or her feet. By pushing on the footrest 412, 414, the occupant pushes themselves back in the aft-facing seat 202, 204, which facilitates using the aft-facing seat 202, 204 when the boat 100 is in operation. The upper surface 416 of the footrest 412, 414 is preferably inclined, with the aftmost part of the upper surface 416 being higher than the foremost part of the upper surface 416. The upper surface 416 is preferably inclined from 10° to 50° relative to the floor 128 of the boat 100.

The footrests 412, 414 may be movable between an extended position, in which the occupant of the associated aft-facing seat 202, 204 may place his or her feet on the upper surface 416 of the footrest 412, 414, and a retracted position. As shown in FIGS. 1 and 2, the port footrest 412 is in the retracted position and the starboard footrest 414 is in the extended position. In FIGS. 1-4, for example, the footrest 412, 414 is pivotable between the extended position and the retracted position. In the extended position, the footrest 412, 414 extends in the aft direction from the transom 114 and is generally perpendicular to the transom 114. In the retracted position, the footrest 412, 414 is pivoted upward so that it is substantially flush with the transom 114.

FIG. 4 shows an alternative arrangement where, instead of the occupant of the aft-facing seat 202, 204 placing his or her feet on a footrest 412, 414, the occupant may place his or her feet on the swim platform 160. In this case, the swim platform 160 is preferably designed to have comfortable footrest 164 below each of the aft-facing seats 202, 204. As with the footrests 412, 414, the footrest 164 on the swim platform 160 is preferably inclined with the aftmost part of the footrest 164 being higher than the foremost part of the footrest 164.

As shown in FIGS. 1 and 2, the boat 100 is further equipped with a plurality of handles 420, 430, which allow one to safely occupy the aft-facing seats 202, 204 while the boat 100 is moving. These handles 420, 430 are positioned so that a person can grasp the handles 420, 430 while seated in one of the aft-facing seats 202, 204. Two handles 420, 430 may be used with each aft-facing seat 202, 204. One handle 420 is at an outboard side of each aft-facing seat 202, 204 and the other handle 430 is at an inboard side of each aft-facing seat 202, 204. The handles 420, 430 are positioned at distance aft of the seatback 220 such that they can be comfortably grasped by a person with their arms bent at the elbows. Preferably, both handles 420, 430 are positioned at the same height. In the embodiment shown, the outboard handle 420 is at substantially the same height as the top of the gunwales 122, 124, and the inboard handle 430 is located on the motor box 150 adjacent to the aft-facing seat 202, 204. These handles 420, 430 are positioned on the boat 100 to avoid interference with the seat bottom 210 and seatback 220 when they are moved upward to their second position (as discussed below). The handles 420, 430 may, however, overlap the seat bottom 210 or be designed to move with the seat bottom 210 and seatback 220.

In addition to being designed to be safely occupied while the boat 100 is moving, the aft-facing seats 202, 204 are designed for convenience and comfort, with features such as a headrest 230 and the ability to be move the seat bottom 210 and/or the seatback 220 in order access compartments 250 below and/or behind the aft-facing seats 202, 204.

Figure 5:
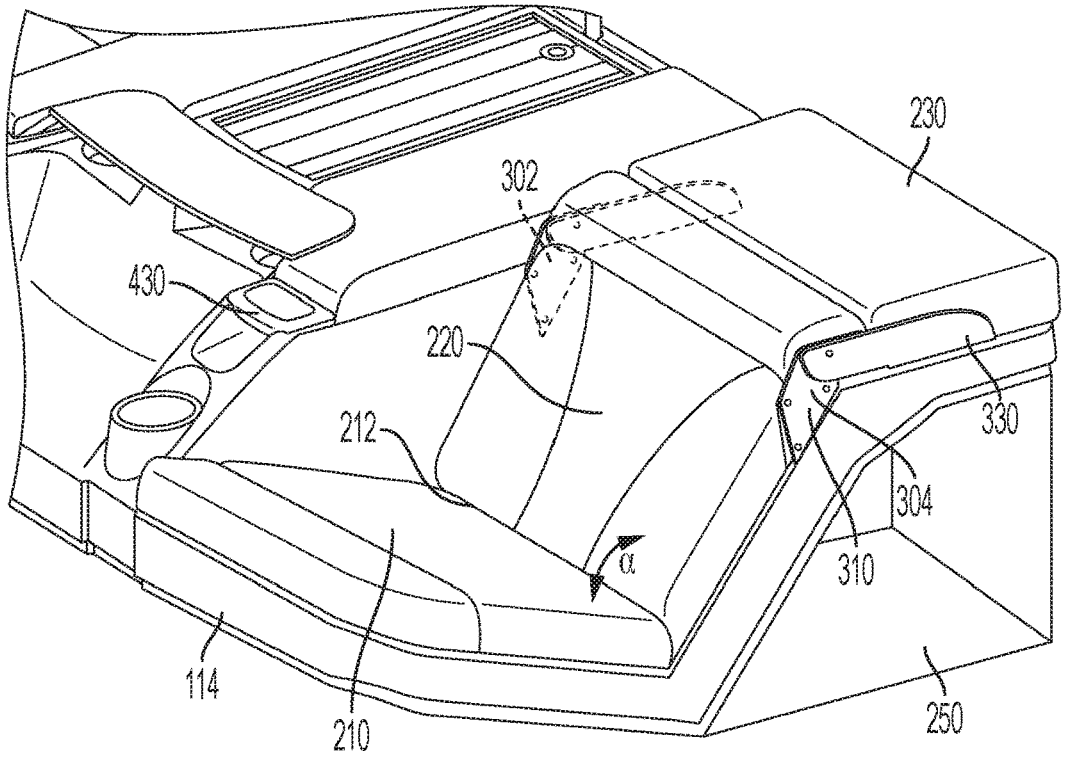
FIG. 5 is a perspective view of the starboard aft-facing seat shown in FIG. 3.
Figure 6:
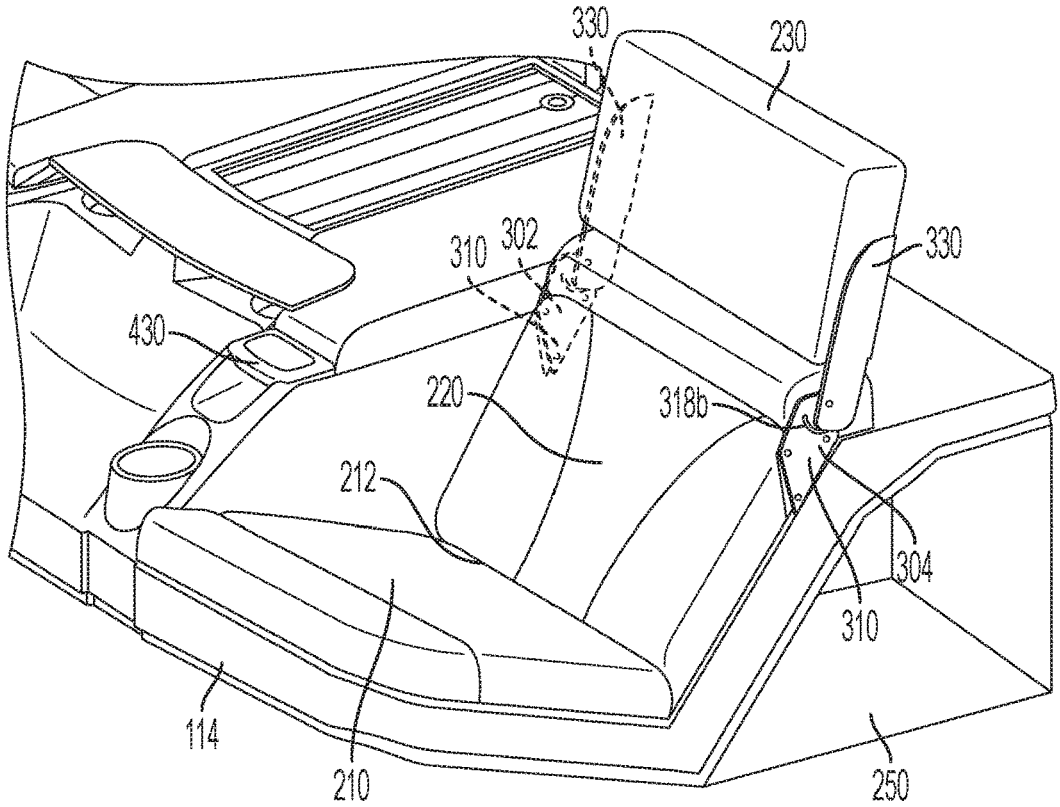
FIG. 6 is a perspective view of the starboard aft-facing seat shown in FIG. 5, with the headrest in an upright position.
Figure 7:
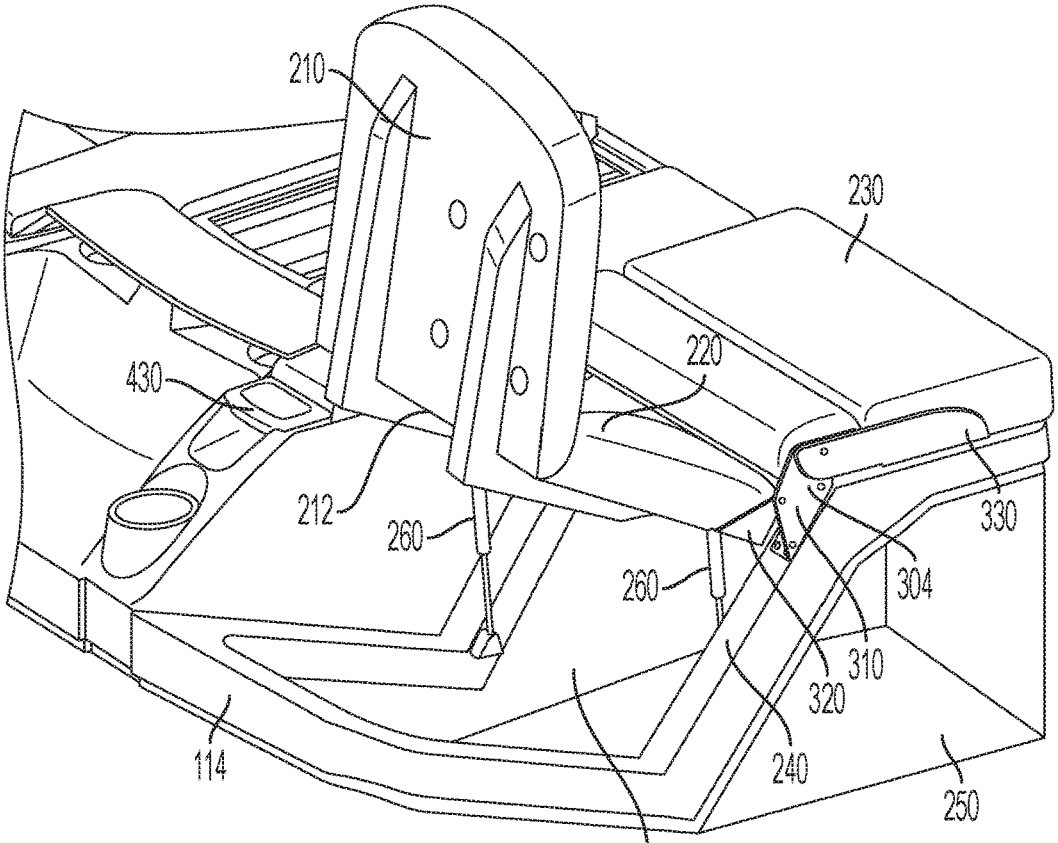
FIG. 7 is a perspective view of the starboard aft-facing seat shown in FIG. 5, with the seatback pivoted upward.
Figure 8:
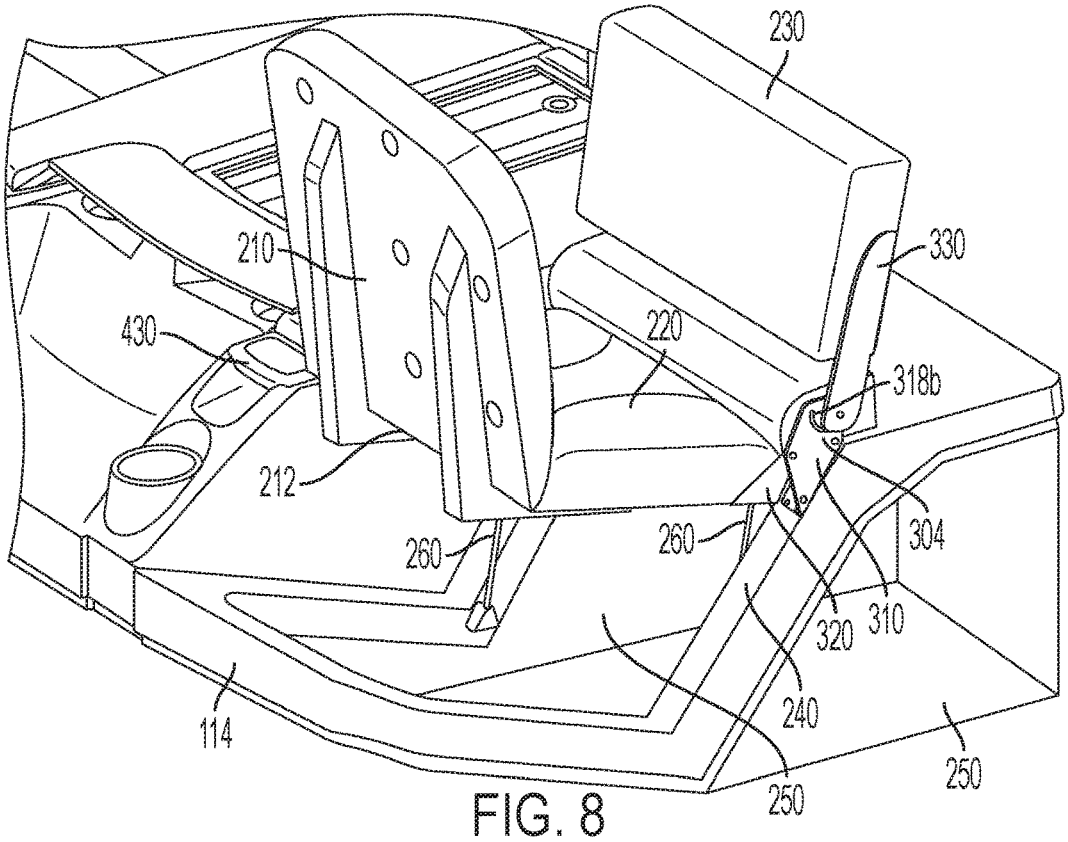
FIG. 8 is a perspective view of the starboard aft-facing seat shown in FIG. 5, with the headrest in the upright position and the seatback pivoted upward.

In the preferred embodiment shown in FIGS. 1-8, each aft-facing seat 202, 204 includes a headrest 230. The headrest 230 is moveable between an upright position and a folded position. FIGS. 1-5 and 7 show the headrest 230 in the folded position and FIGS. 6 and 8 show the headrest 230 in the upright position. Like the seat bottom 210 and the seatback 220, in this embodiment, the headrest 230 is made from a cushion covered with a premium grade vinyl supported by a structural member. The headrest 230 is attached to two pivot mechanisms 302, 304 (discussed further below) to pivot between the upright and folded positions.

As discussed above, the boat 100 preferably includes two compartments 250 on either side of the motor 142. Watersports performers often use the swim platform 160 to put on and adjust their equipment, for example: tow ropes, life jackets, water skis, wakeboards, etc. By allowing access to these compartments 250 from the swim platform 160, these compartments 250 can conveniently be used to store equipment for watersports performers. Each aft-facing seat 202, 204 is moveable to allow access to the compartment 250 from the swim platform 160. In this embodiment, the seatback 220 is pivotable between a first position, in which the seatback 220 is capable of supporting the back of a person seated in the aft-facing seat 202, 204, and a second position, in which the seatback 220 is pivoted upwardly to allow access to the compartment 250. The seat bottom 210 is also movable between a first position, in which the seat bottom 210 is capable of supporting the bottom of a person seated in the aft-facing seat 202, 204, and a second position, in which the seatback 220 is pivoted upwardly to allow access to the portion of the compartment 250 below the seat bottom 210. In this embodiment, the seat bottom 210 and seatback 220 pivot together because they are integrally formed, but in other embodiments, they can be moved separately, or only one of the seat bottom 210 and the seatback 220 may be moveable. FIGS. 1-6 show the seatback 220 in the first position, and FIGS. 7 and 8 show the seatback 220 in the second position.

The seat bottom 210 and the seatback 220 pivot between the first and second position using a pair of pivot mechanisms 302, 304. In the embodiment shown in FIGS. 5-10, the pivot mechanisms 302, 304 used for the headrest 230 are the same pivot mechanisms 302, 304 used for the seatback 220. A first pivot mechanism 302 is located on an inboard side of the seat support structure 240 and a second pivot mechanism 304 is located on an outboard side of the seat support structure 240. Both the first and second pivot mechanisms 302, 304 are symmetrical and the following description of the second pivot mechanism 304 of the starboard seat 204 applies equally to the first pivot mechanism 302 of the starboard seat 204, as well as to both pivot mechanisms 302, 304 of the port seat 202.

Figure 9:
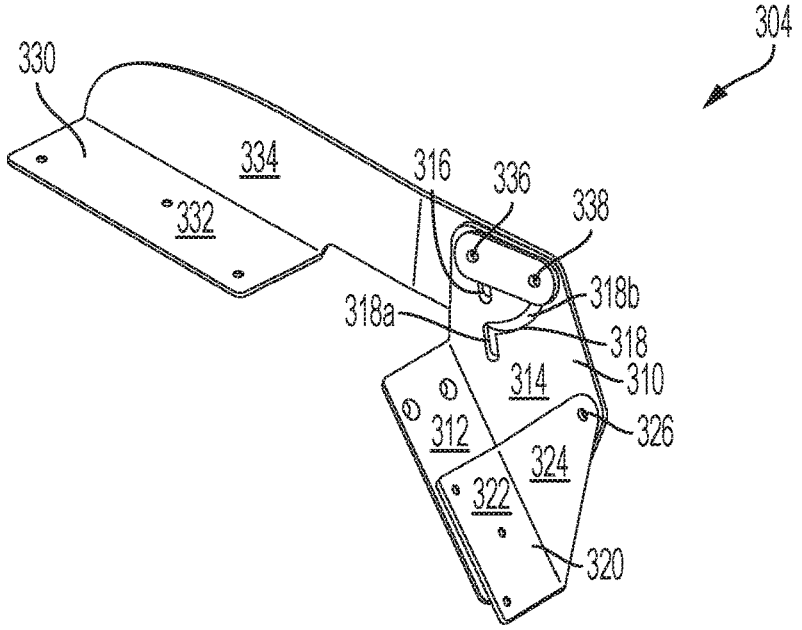
FIG. 9 is a perspective view of a pivot mechanism according to a preferred embodiment of the invention.
Figure 10:
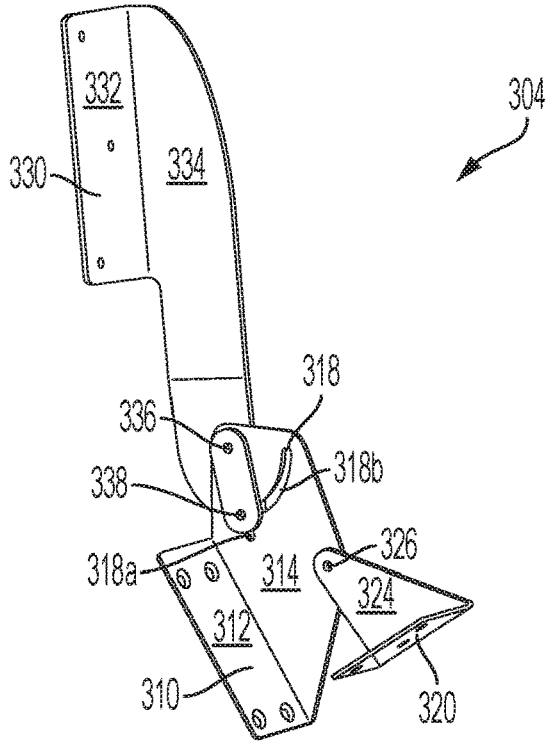
FIG. 10 is a perspective view of the pivot mechanism shown in FIG. 9, with a headrest bracket in an upright position and a seatback bracket pivoted upward.

As shown in FIGS. 9 and 10, the second pivot mechanism 304 of the starboard seat 204 has three brackets: a base bracket 310, a backrest bracket 320, and a headrest bracket 330. All three brackets 310, 320, 330 are generally L-shaped. The base bracket 310 has a first surface 312 which is mounted to the seat support structure 240 using fasteners. In this embodiment, the fasteners used to attach the base bracket 310 to the seat support structure 240 are screws; however, any suitable means of attachment known in the art may be used including bolts, rivets, welding, adhesive, and the like. The base bracket 310 is mounted near the top of the support structure 240 and near both the seatback 220 and the headrest 230. The base bracket 310 also has a second surface 314 which is generally perpendicular to the first surface 312 to form the L-shape of the bracket. Both the backrest bracket 320 and the headrest bracket 330 are pivotably connected to the second surface 314 of the base bracket 310.

The backrest bracket 320 also includes a first surface 322 and a second surface 324, which is generally perpendicular to the first surface 322. The first surface 322 of the backrest bracket 320 is connected to the seatback 220. In this embodiment, the first surface 322 is directly connected to the seatback 220 using fasteners, including, for example, screws; however, any suitable means of attachment known in the art may be used including bolts, rivets, welding, adhesive, and the like. The second surface 324 of the backrest bracket 320 is pivotably connected to the base bracket 310. In this embodiment, the pivotable connection is made using a pin 326, such as the shank of a rivet, but any suitable pivotable connection may be used. The pin 326 is inserted through holes formed on both the second surface 314 of the base bracket 310 and the second surface 324 of the backrest bracket 320. Both holes are located on a side of the second surfaces 314, 324, that is, away from their respective first surfaces 312, 322. This configuration allows the backrest bracket 320 to freely pivot about the pivotable connection between the first position (see FIG. 9) and the second position (see FIG. 10), and allows the backrest bracket 320 to nest above the base bracket 310 in the first position, as shown in FIGS. 5, 6, and 9.

The aft-facing seats 202, 204 may also include features to help lift the seat bottom 210 and the seatback 220 and hold them in the second position. Such features may include, for example, pneumatic cylinders 260. One end of each pneumatic cylinder 260 may be attached to the seat support structure 240 and the other may be attached to the seatback 220, as shown in FIGS. 7 and 8.

Similar to the base bracket 310 and the backrest bracket 320, the headrest bracket 330 includes a first surface 332 and a second surface 334, which is generally perpendicular to the first surface 332. The first surface 332 of the headrest bracket 330 is connected to the headrest 230. In this embodiment, the first surface 332 is directly connected to the headrest 230 using fasteners, including, for example, screws; however any suitable means of attachment known in the art may be used including bolts, rivets, welding, adhesive, and the like. The second surface 334 of the headrest bracket 330 is elongated with one end pivotally connected to the base bracket 310. The headrest 230 and headrest bracket 330 pivot about this pivotable connection to move between the folded and the upright positions. Preferably, the pivotable connection is designed to hold the headrest 230 in the upright position.

In this embodiment, the headrest bracket 330 is pivotably connected to the base bracket 310 by two pins 336, 338, a first pin 336 and a second pin 338. The first pin 336 engages a first slot 316 formed in the second surface 314 of the base bracket 310, and the second pin 338 engages with a second slot 318 formed in the second surface 314 of the base bracket 310. In this embodiment, the first and second pins 336, 338 are shanks of rivets, but any pin or other connection suitable for moving in the first and second slots 316, 318 may be used.

The first slot 316 is generally linear and oriented along a first linear path. In this embodiment, the first linear path is generally parallel to a bottom surface of the structural member of the headrest 230 in the upright position. The first slot 316 has two ends, an upper end and a lower end. The upper end is closer to the headrest 230 than the lower end.

In this embodiment, the second slot 318 is located farther from the headrest 230 than the first slot 316 is from the headrest 230. The second slot 318 has two portions, a linear portion 318*a* and a curved portion 318*b*. The linear portion 318*a* of the second slot 318 is oriented along a line that is parallel to the first linear path. Preferably, the linear portion 318*a* of the second slot 318 is co-linear with the first slot 316; that is, both the first slot 316 and the linear portion 318*a* of the second slot 318 are oriented along the first linear path. The linear portion 318*a* of the second slot 318 has two ends, an upper end and a lower end. The upper end is the end closest to the first slot 316. The curved portion 318*b* of the second slot 318 extends from the upper end of the linear portion 318*a* and extends in a direction away from the first surface 312 of the base bracket 310. The curved portion 318*b* of the second slot 318 also has two ends, an upper end and a lower end. The lower end of the curved portion 318*b* is the upper end of the linear portion 318*a*.

The first and second pins 336, 338 slide in the first and second slots 316, 318, respectively, to allow the headrest 230 to move between the folded and the upright positions. Starting in the folded position, the first pin 336 is located in the upper end of the first slot 316 and the second pin 338 is located in the upper end of the curved portion 318*b* of the second slot 318. The first pin 336 and second pin 338 are set at a constant distance apart. The curved portion 318*b* is curved with a radius centered on the upper end of the first slot 316 and equal to the distance between the first pin 336 and the second pin 338. To move the headrest 230 from the folded position (shown in FIG. 5), a user lifts the headrest 230 and rotates it to the upright position (shown in FIGS. 6 and 8). The headrest bracket 330 is shown in the folded position in FIG. 9. As the headrest 230 is raised, the headrest bracket 330 pivots about the first pin 336, and the second pin 338 slides from the upper end of the curved portion 318*b* of the second slot 318 to the lower end of the curved portion 318*b* of the second slot 318. As a result, the second pin 338 is now located in the upper end of the linear portion 318*a* of the second slot 318. This position of the headrest bracket 330 is shown in FIG. 10.

To hold the headrest 230 in the upright position, the first and second pins 336, 338 slide to the lower end of the first slot 316 and the linear portion 318*a* of the second slot 318, respectively. Gravity assists in keeping the first and second pins 336, 338 at the lower ends of their respective slots, and in this position, the headrest bracket 330 is prevented from rotating about the first pin 336 back to the folded position.

To move the headrest 230 from the upright position to the folded position, the process described above is reversed. A user lifts the headrest 230 to slide the first pin 336 from the lower end to the upper end of the first slot 316 and to slide the second pin 338 from the lower end to the upper end of the linear portion 318*a* of the second slot 318. Then the headrest 230 and headrest bracket 330 are pivoted about the first pin 336, as the second pin 338 moves from the lower end of the curved portion 318*b* of the second slot 318 to the upper end of the curved portion 318*b* of the second slot 318.

Figure 11:
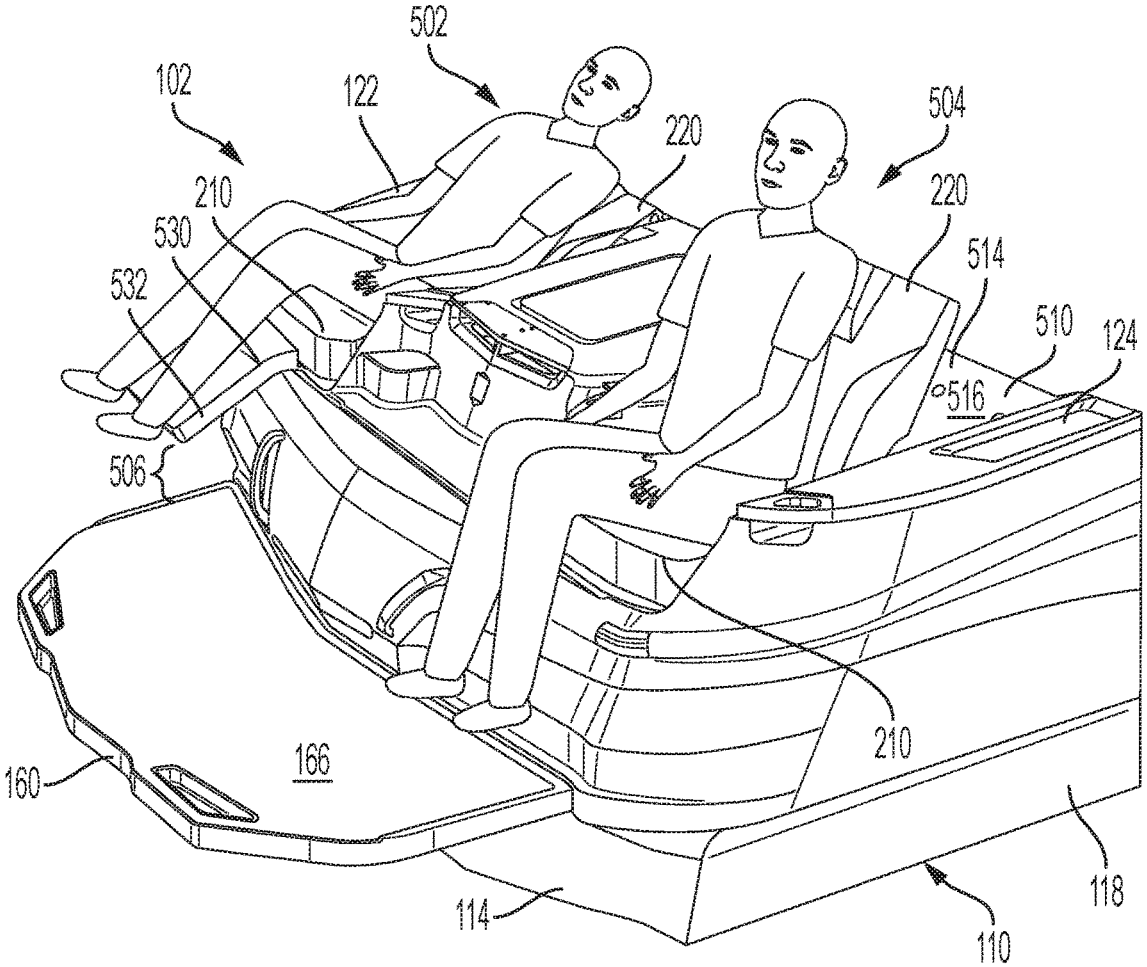
FIG. 11 is a perspective view of the stern of the boat including a pair of aft-facing seats according to another preferred embodiment of the invention.

Another pair of aft-facing seats 502, 504 according to a second preferred embodiment of the invention is shown in FIG. 11. A port-side aft-facing seat 502 ("port seat") is located on the port side of the centerline of the boat 100, and a starboard-side aft-facing seat 504 ("starboard seat") is located on the starboard side of the centerline of the boat 100. The pair of aft-facing seats 502, 504 of this embodiment have many of the same features as the pair of aft-facing seats 202, 204 of the first embodiment. The same reference numerals will be used in this embodiment to refer to the same or similar components and features as in the first embodiment and a detailed description of these components and features will be omitted.

As with the pair of aft-facing seats 202, 204 of the first embodiment, the pair of aft-facing seats 502, 504 of the second embodiment include a seat structural member 510 that is generally L-shaped and constructed from a light-weight material, such as polyethylene, and made by roto-molding (also known as rotocasting). The seat structural member 510 has a lower portion 512 and an upper portion 514. Each of the lower portion 512 and the upper portion 514 have an upper surface 516, 518, which supports the seat bottom 210 and the seatback 220, respectively.

Figure 12:
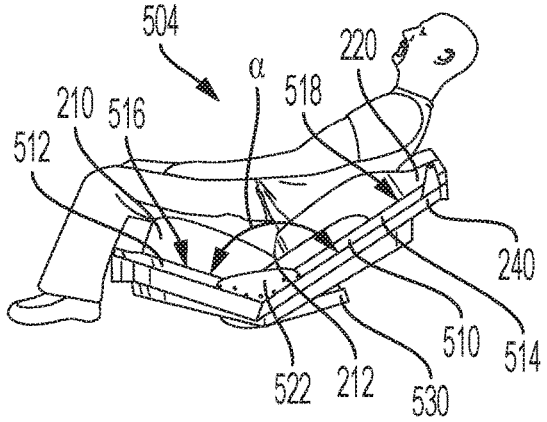
FIG. 12 is a side view the starboard aft-facing seat shown in FIG. 11, taken from the perspective of line 3-3 in FIG. 2 with a seatback in a reclined position.
Figure 13:
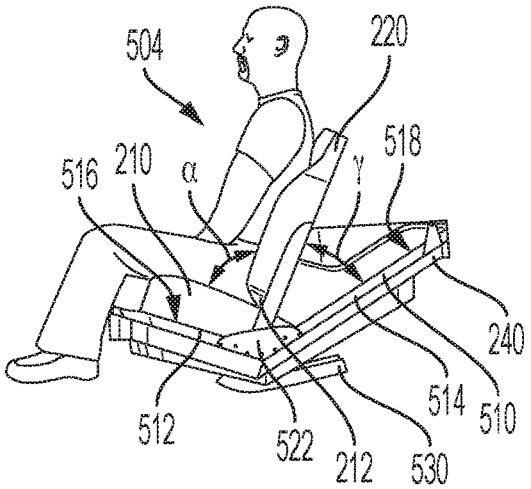
FIG. 13 is the side view of the starboard aft-facing seat shown in FIG. 12, with the seatback in an upright position.

In this embodiment, the seatback 220 is moveable between a reclined position and an upright position. In FIG. 11, the port seat 502 is in the reclined position and the starboard seat 504 is in an upright position. FIGS. 12 and 13 are side views of the starboard seat 504 taken from the taken from the perspective of line 3-3 in FIG. 2. FIG. 12 shows the seatback 220 in the reclined position, and FIG. 13 shows the seatback 220 in the upright position. In the reclined position, the seatback 220 is supported by the upper surface 518 of the upper portion 514 and the upper surface of the seatback 220 is generally parallel to the upper surface 518 of the upper portion 514. Likewise, the upper surface of the seat bottom 210 is generally parallel to the upper surface 516 of the lower portion 512. As discussed in the first embodiment, an angle α formed between the upper surface 516 of the lower portion 512 and the upper surface 518 of the upper portion 514 is preferably set so that a person can sit comfortably in a reclined position in the port seat 502 or the starboard seat 504.

In this embodiment, the seatback 220 is moveable between the reclined position and a plurality of upright positions. To move from the reclined position to an upright position, the seatback 220 is pivoted toward the seat bottom 210 about a pivot located at the intersecting point 212 (direction A in FIG. 14). In an upright position, the angle α between the seat bottom 210 and the seatback 220 is less than it is in the reclined position, and an angle γ is formed between the upper surface 518 of the upper portion 514 of the seat structural member 510. In this embodiment, two pivot mechanisms 522 are used to pivot the seatback 220 between the reclined and upright positions, one on the inboard side of the seatback 220 and one on the outboard side of the seatback 220. Although any suitable pivot mechanism 522 may be used, the pivot mechanisms 522 of this embodiment are ratchet hinges similar to the Command Ratchet Hinges made by Taco Marine of Miami, Fla.

The seatback 220 is raised to a first predetermined angle of angle γ, such as 36 degrees, for example, after which the hinge engages and holds the seatback 220 in an upright position and prevents the seatback 220 from returning to the reclined position. Below the first predetermined angle, the pivot mechanism 522 does not hold the seatback 220 in an upright position and the seatback 220 will return to the reclined position when the seatback 220 is released. To move the seatback 220 to other upright positions of the plurality of upright positions beyond the first predetermined angle, the seatback 220 is pivoted farther toward the seat bottom 210 in direction A.

Figure 14:
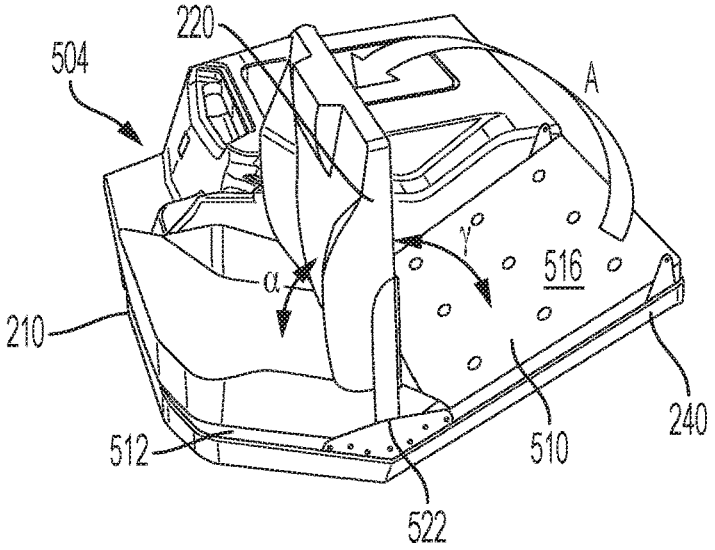
FIG. 14 is a perspective view of the starboard aft-facing seat shown in FIG. 11, with the seatback in a release position.

To release the seatback 220 and allow it to return to the reclined position, the seatback 220 is pivoted toward the seat bottom 210 to an angle that exceeds a second predetermined angle of angle γ, in this embodiment 90 degrees. Once the seatback 220 is pivoted to an angle that exceeds the second predetermined angle, the seatback 220 is free to pivot away from the seat bottom 210 (a direction opposite direction A) and return to the reclined position. FIG. 14 shows the seatback 220 moved to second predetermined angle which is the release point of the pivot mechanisms 522.

Each of the port seat 502 and the starboard seat 504 of the second embodiment includes a leg rest 530. The leg rest 530 may also be considered a footrest and have a length with an appropriately sized and located cushion to support the feet of a person seated in the port seat 502 or the starboard seat 504; however, this component will be referred to as a leg rest herein to distinguish it from the port footrest 412 and the starboard footrest 414 described in the first embodiment.

The leg rest 530 of this embodiment is movable between an extended position and a retracted position. In FIG. 11, the leg rest 530 corresponding to the port seat 502 is shown in the extended position, and the leg rest 530 corresponding to the starboard seat 504 is shown in the retracted position. Similarly, the leg rest 530 corresponding to the port seat 502 is shown in the extended position in FIG. 15. FIGS. 17-20 show the leg rest 530 in the extended position. The leg rest 530 includes a cushion 532 having an upper surface 534 which supports the legs of the person seated in the port seat 502 or the starboard seat 504. The cushion 532 of the leg rest 530 is adjacent to the cushion of the seat bottom 210 and extends outward from the seat bottom 210 in a direction away from the seatback 220. The cushion 532 of the leg rest 530 also extends at a downward angle relative to the seat bottom 210. In particular, the upper surface 534 of the cushion 532 of the leg rest 530 forms an angle δ with the upper surface of the seat bottom 210 (see FIG. 19). The downward angle (angle δ) of the cushion 532 may be set at any suitable angle to comfortably support a person's legs and feet. In this embodiment angle δ is preferably between 205 degrees and 240 degrees.

Figure 15:
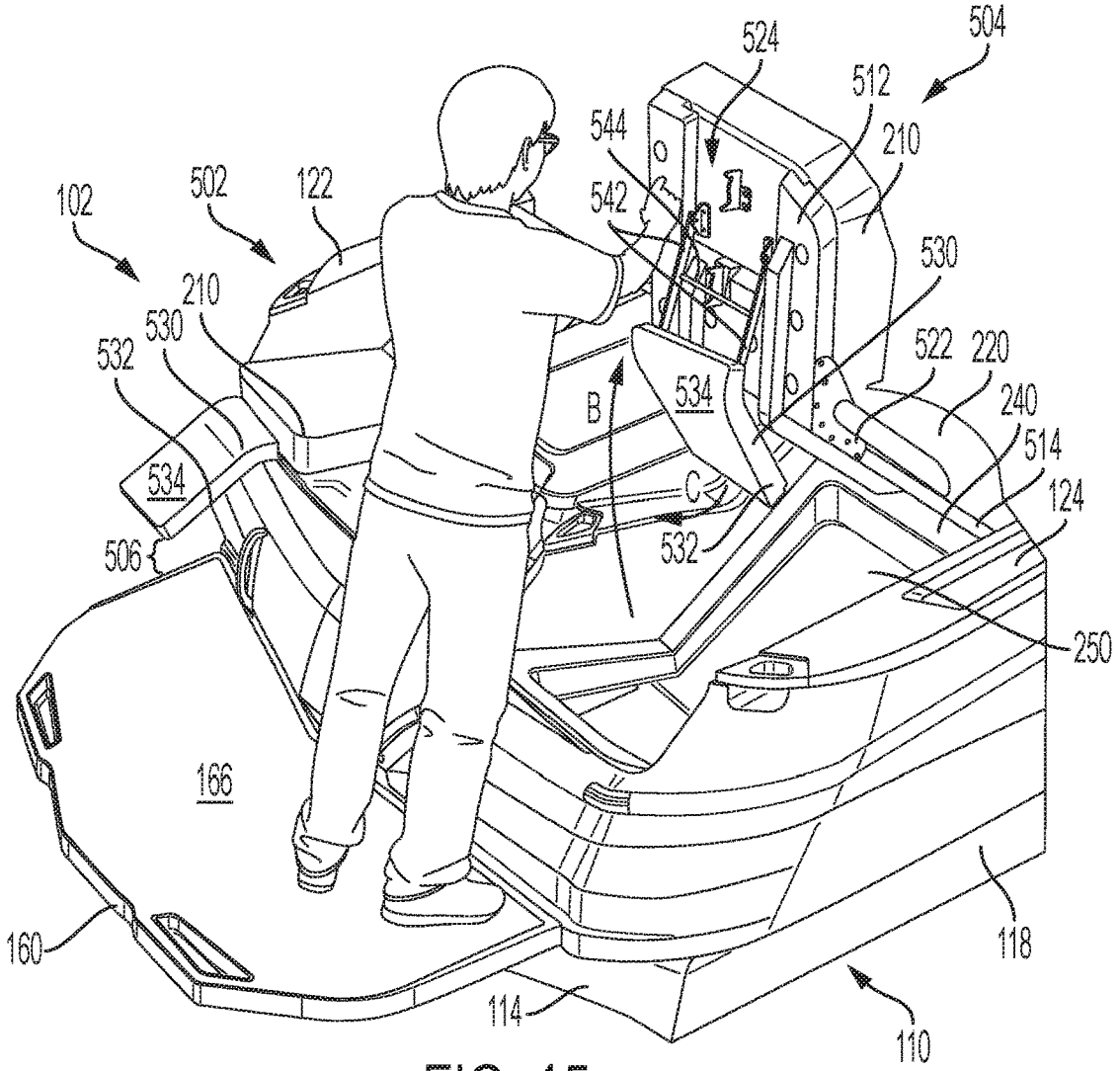
FIG. 15 is a perspective view of the stern of the boat including the pair of aft-facing seats shown in FIG. 11, with the starboard aft-facing seat in a second position.

In this embodiment, as in the first embodiment, the aft-facing seats 502, 504 are positioned over the transom 114, with the seat bottom 210 positioned above the transom 114 (see FIGS. 11 and 15). While seated in one of the aft-facing seats 502, 504, the legs of an adult's body extend aft, over the transom 114, and thus, in this embodiment, the leg rest 530 extends aft of the transom 114 at a downward angle extending from fore to aft.

As will be detailed further below, the leg rest 530 of this embodiment is supported on its upper side and is not supported by a surface underneath it. In this embodiment, with the leg rest 530 extending aft from the transom 114, the leg rest 530 extends over the swim platform 160 and the leg rest 530 is thus not supported by the upper surface 166 of the swim platform 160, which is underneath the leg rest 530. The leg rest 530 has a length that is such that a gap 506 is present between the lower, aft end of the cushion 532 of the leg rest 530 and the upper surface 166 of the swim platform 160.

Figure 16:
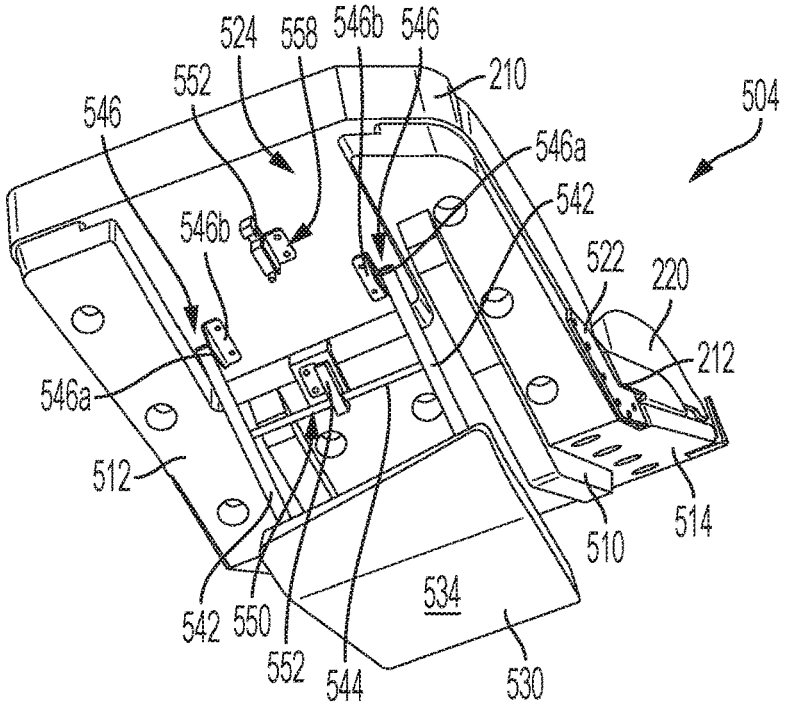
FIG. 16 is an underside view of one of the aft-facing seats shown in FIG. 11, with a leg rest in a retracted position.
Figure 17:
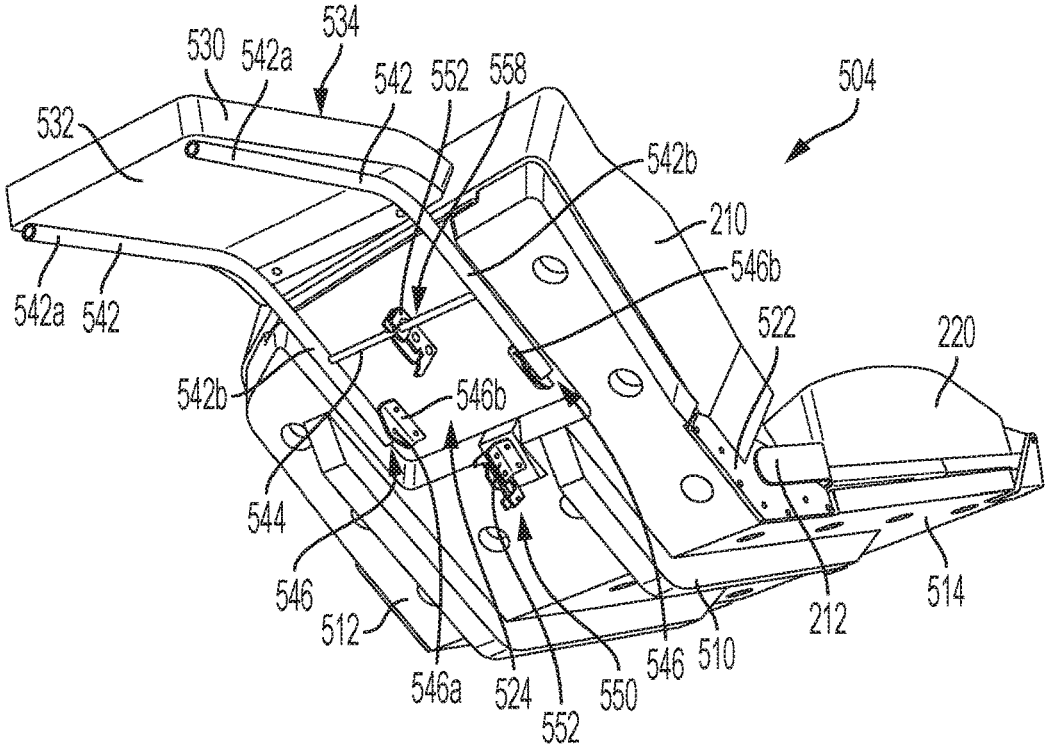
FIG. 17 is an underside view of one of the aft-facing seats shown in FIG. 11, with the leg rest in an extended position.

As can be seen in FIGS. 16 and 17, the cushion 532 is supported by a structural support or structural member(s). In this embodiment, the structural support of the leg rest 530 comprises a pair of circular, hollow, stainless steel tubes 542 (referred to herein as support tubes 542). The geometry of these structural members is not so limited, and instead, any other suitable configuration, shape, and material of construction may be used, including a beam, rod, or the like. The support tubes 542 are positioned parallel to each other, and each support tube 542 is generally L-shaped. A first leg 542*a* of the L-shape is located underneath the cushion 532 and parallel to the upper surface 534 of the cushion 532, and the cushion 532 is attached to an upper surface of the first leg 542*a*. A second leg 542*b* of the L-shape is located generally parallel to the upper surface of the seat bottom 210 when the leg rest 530 is in the extended position. The second legs 542*b* of each support tube 542 are connected to each other by a connecting tube 544, which, in this embodiment, is connected orthogonally to each second leg 542*b* in the middle of each second leg 542*b*. As with the support tubes 542, the connecting tube 544 of this embodiment is a circular, hollow, stainless steel tube, but the geometry is not so limited, and instead, any other suitable configuration, shape, and material of construction may be used, including a beam, rod, or the like.

In this embodiment, the leg rest 530 rotates to move between the extended position and the retracted position. The end of the second leg 542*b* that is located away from the cushion 532 is pivotably attached to the underside of the seat bottom 210 by a pivot mechanism 546. Any suitable pivotable connection may be used, but in this embodiment a pin 546*a* is used to connect the second leg 542*b* of the support tube 542 to an L-bracket 546*b* attached to the underside of the seat bottom 210. Although in this embodiment the support tube 542 is pivotably attached to the seat bottom 210, the invention is not so limited, and the leg rest 530, and in particular the support tubes 542, may be pivotably attached to other suitable locations including, for example, the seat support structure 240 or the seat structural member 510.

FIG. 16 shows the leg rest 530 in the retracted position. In the retracted position, the second leg 542*b* extends along the underside of the seat structural member 510 in a direction from the pivot mechanism 546 toward the seatback 220. In this embodiment, the L-shape of the support tube 542 is fixed, and thus, in the retracted position, the cushion 532 extends upward and forward under the upper portion 514 of the seat structural member 510.

As in the first embodiment, the seat structural member 510 is pivotable between a first position in which the seat bottom 210 and the seatback 220 are capable of supporting a person seated in the aft-facing seat 202, 204 and a second position in which the seat structural member 510, including the seat bottom 210 and the seatback 220, is pivoted upwardly to allow access to the compartment 250. With the seat structural member 510 in the first position, the leg rest 530, when in the retracted position, is located within the compartment 250. Positioning the leg rest 530 on the underside of the seat structural member 510 not only facilitates moving the leg rest 530 to the extended position (as will be discussed below), but minimizes the interference between the leg rest 530 and items stored in the compartment 250.

The leg rest 530 is movable from the retracted position to the extended position when the seat structural member 510 is in the second position. In FIG. 15, the starboard seat 504 is shown in the second position. As the seat structural member 510 is moved upward in direction B from the first position to the second position, a locking mechanism 550 (first locking mechanism 550) is used to hold the leg rest 530 under the seat structural member 510 and prevent the leg rest 530 from swinging downward. In this embodiment, the locking mechanism 550 includes a latch 552 attached to the underside of the lower portion 512 of the seat structural member 510 (see FIG. 16). The latch 552 engages with and latches the connecting tube 544 to hold the leg rest 530.

Figure 18:
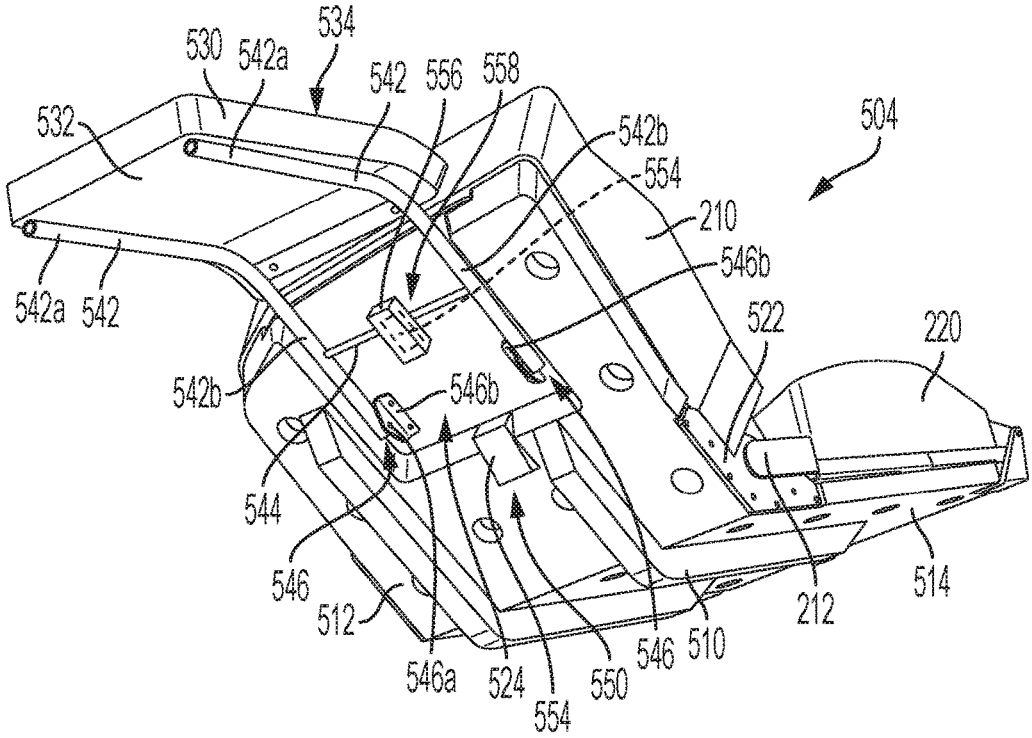
FIG. 18 is an underside view of one of the aft-facing seats shown in FIG. 11, with the leg rest in the extended position and having an alternative locking mechanism.

The locking mechanism 550 is not limited to a latch, and any suitable locking mechanism 550 may be used. For example, an alternative locking mechanism 550 is shown in FIG. 18. The locking mechanism 550 shown in FIG. 18 includes a magnet 554 (a first magnet 554) and an attracted member 556. The magnet 554 is a permanent magnet in this embodiment. The attracted member 556 may be any suitable material that is attracted to and held by the magnet 554; such materials include, for example, ferromagnetic materials or even a second magnet arranged such that the polarity of the second magnet 556 is attracted to the first magnet 554. In this embodiment, the magnet 554 is located on the lower portion 512 of the seat structural member 510, and the attracted member 556 is located on the connecting tube 544 of the leg rest 530. But, these components may also be reversed with the attracted member 556 being located on the seat structural member 510 and the magnet 554 being located on the leg rest 530.

Once the seat structural member 510 is in the second position, as shown in FIG. 15, a user disengages the locking mechanism 550 and pivots the leg rest 530 about the pivot axis of the pivot mechanism 546 to rotate the leg rest 530 in direction C to the extended position. Another locking mechanism 558 (second locking mechanism 558) is used to hold the leg rest 530 in the extended position. The second locking mechanism 558 is the same as the locking mechanism 550 in the embodiments shown in FIGS. 15-18. The latch 552 (or magnet 554 or attracted member 556) is attached to the underside of the seat bottom 210 in this embodiment. As shown in FIG. 17, the latch 552 of the second locking mechanism 558 engages with the connecting tube 544 to hold the leg rest 530 in the extended position. The seat structural member 510 includes a U-shaped cutout 524. The cutout 524 enables the support tubes 542 to be positioned on the underside of the seat bottom 210 in the extended position.

Figure 19:
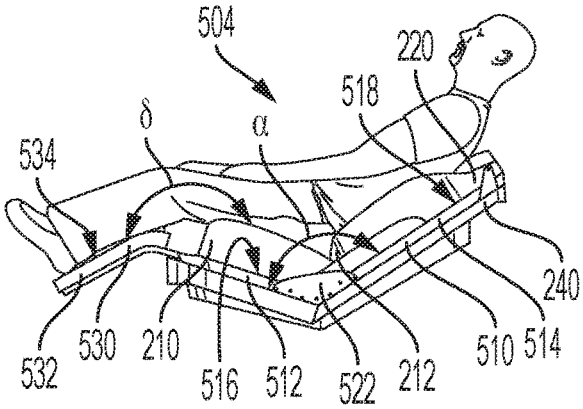
FIG. 19 is the side view of the starboard aft-facing seat shown in FIG. 12, with the leg rest in the extended position and the seatback in the reclined position.
Figure 20:
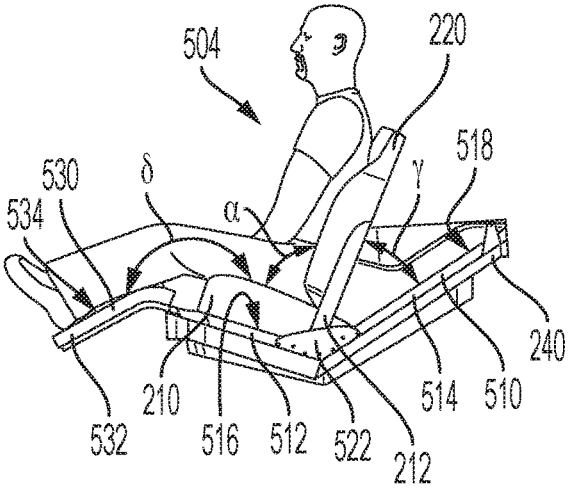
FIG. 20 is the side view of the starboard aft-facing seat shown in FIG. 12, with the leg rest in the extended position and the seatback in the upright position.

After engaging the leg rest 530 with the second locking mechanism 558, the user then lowers the seat structural member 510 to the first position. With the seat structural member 510 in the first position, a person can sit in the starboard seat 504. FIGS. 19 and 20 show a person seated in the starboard seat 504 with the leg rest in the extended position. In FIG. 19, the seatback 220 is in the reclined position, and in FIG. 20 the seatback 220 is in an upright position. To move from the extended position to the retracted position, the process is reversed.

Figure 21:
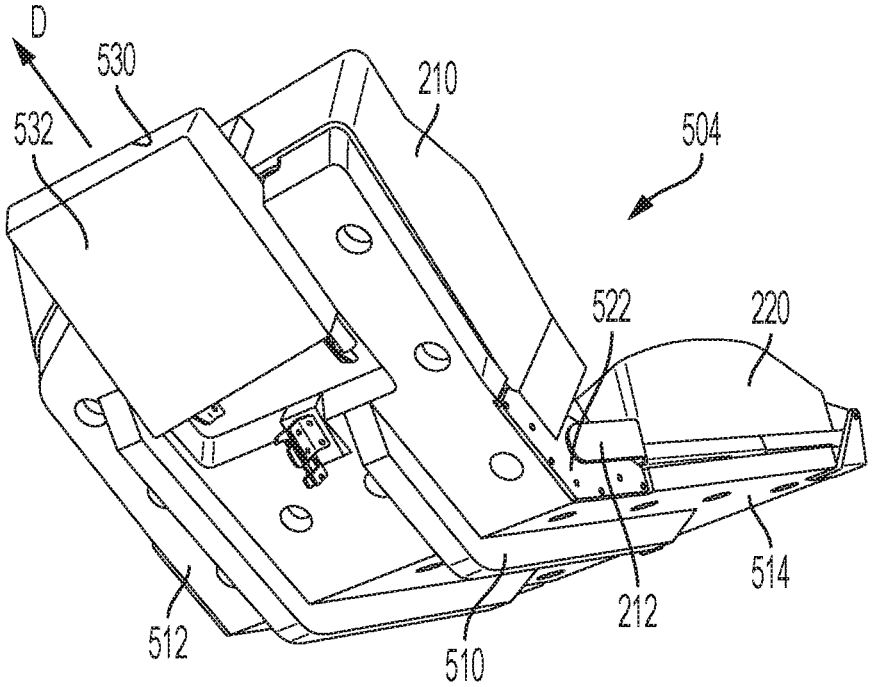
FIG. 21 is an underside view of one of the aft-facing seats shown in FIG. 11, with an alternate movement mechanism for moving the leg rest between the extended position and the retracted position.

The leg rest 530 shown in FIGS. 15-18 is movable between the extended and retracted positions by rotation. The movement of the leg rest 530 is not so limited, however, and any suitable mechanism and movement may be used to move the leg rest 530 between the extended position and the retracted position. For example, the cushion 532 may slide in direction D, as shown in FIG. 21, to move from the retracted position to the extended position. Any suitable sliding mechanism may be used, including, for example, a rail system or telescoping tubes.

Although the seats 202, 204, 502, 504 have been described as aft-facing seats, they are not so limited, and the seats 202, 204, 502, 504 and features thereof, such as the leg rest 530, may be used in other locations within the boat. For example, the leg rest 530 may be used in seats located in a primary seating area 121 located within the interior 120 of the boat 100. When located in another location, such as the primary seating area, the leg rest 530 in the extended position is positioned with the gap 506 being relative to an upper surface of the deck of the boat 100, such as the floor 128, instead of the upper surface 166 of the swim platform 160.

While the forgoing discussion references certain materials, those skilled in the art will recognize that any material suitable for use in a marine environment and having other suitable characteristics for performing the functions discuss above (for example, strength and wear resistance) may be used in this invention.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A boat comprising:

a hull including a bow, a transom, port and starboard sides, and port and starboard gunwales;

a seat support structure having at least one hidden compartment therein; and an aft-facing seat positioned proximate to the transom and supported by the seat support structure, the aft-facing seat including:

a seat bottom movable between a first position and a second position, wherein, when the seat bottom is in the first position, the seat bottom is inclined at a downward angle in a direction extending from aft to fore and a majority of the seat bottom is positioned forward of the transom, and wherein the second position is a position in which the seat bottom is pivoted upwardly relative to the position of the seat bottom in the first position to allow access to the compartment; and a seatback that joins the seat bottom at an intersecting location, wherein, when the seat bottom is in the first position, the intersecting location is forward of the transom and below the gunwales.

2. The boat of claim 1, wherein the aft-facing seat further includes a leg rest extending aft of the seat bottom that is inclined at a downward angle in a direction extending from fore to aft.

3. The boat of claim 2, wherein the leg rest is movable between an extended position and a retracted position, the leg rest being inclined at the downward angle in a direction extending from fore to aft in the extended position.

4. The boat of claim 3, wherein the aft-facing seat further includes a locking mechanism for locking the leg rest in at least one of the extended position and the retracted position.

5. The boat of claim 4, wherein the locking mechanism is a latch.

6. The boat of claim 3, wherein the leg rest is configured to pivot about a pivot axis when moving between the extended position and the retracted position.

7. The boat of claim 6, wherein the leg rest is pivotable about the pivot axis to move between the extended position and the retracted position when the seat bottom is in the second position.

8. The boat of claim 7, wherein, in the retracted position, the leg rest is located within the hidden compartment.

9. The boat of claim 7, wherein the leg rest is pivotably attached to the seat bottom.

10. A boat comprising:

a hull including a bow, a transom, and port and starboard sides;

a seat support structure having at least one hidden compartment therein; and an aft-facing seat positioned proximate to the transom and supported by the seat support structure, the aft-facing seat including:

a seat bottom movable between a first position and a second position, wherein the second position is a position in which the seat bottom is pivoted upwardly relative to the position of the seat bottom in the first position to allow access to the compartment; and a leg rest movable between an extended position and a retracted position when the seat bottom is in the second position and configured to pivot about a pivot axis when moving between the extended position and the retracted position, the leg rest extending aft of the transom in the extended position and when the seat bottom is in the first position.

11. The boat of claim 10, wherein the leg rest, when in the extended position, extends in a direction that is downward from the seat bottom when the seat bottom is in the first position.

12. A boat comprising:

a hull including a bow and port and starboard sides; and a seat including a seat bottom and a leg rest, the leg rest extending in a direction that is at a downward angle relative to the seat bottom, the leg rest having an upper portion and a lower end, the leg rest being supported at the upper portion with a gap between the lower end of the leg rest and a surface beneath the leg rest such that the leg rest is not supported by the surface underneath the leg rest.

13. The boat of claim 12, wherein the seat is located in the stern of the boat and is aft facing.

14. The boat of claim 12, further comprising a swim platform, wherein the surface beneath the leg rest is an upper surface of the swim platform.

15. The boat of claim 14, wherein the hull further includes a transom, the swim platform is attached to the transom, the seat is positioned proximate to the transom, and the leg rest extends aft of the transom.

16. The boat of claim 12, further comprising a deck, wherein the surface beneath the leg rest is an upper surface of a portion of the deck.

17. The boat of claim 12, wherein the leg rest is movable between an extended position and a retracted position, and the leg rest, when in the extended position, extends in a direction that is downward from the seat bottom.

18. The boat of claim 17, wherein the leg rest is configured to slide when moving between the extended position and the retracted position.

19. The boat of claim 17, wherein the leg rest is configured to pivot about a pivot axis when moving between the extended position and the retracted position.

20. The boat of claim 10, wherein, in the retracted position, the leg rest is located within the hidden compartment.

* * * * *